US006874468B2

(12) United States Patent
Watanabe

(10) Patent No.: US 6,874,468 B2
(45) Date of Patent: Apr. 5, 2005

(54) THROTTLE VALVE CONTROL DEVICE

(75) Inventor: Shinji Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/757,998

(22) Filed: Jan. 16, 2004

(65) Prior Publication Data

US 2004/0149260 A1 Aug. 5, 2004

(30) Foreign Application Priority Data

Jan. 20, 2003 (JP) ..... 2003-010501

(51) Int. Cl.[7] ..... F02P 31/00
(52) U.S. Cl. ..... 123/377; 123/376
(58) Field of Search ..... 123/377, 376, 123/363, 319

(56) References Cited

U.S. PATENT DOCUMENTS 5,113,823 A * 5/1992 Iriyama ..... 123/399
5,367,997 A * 11/1994 Kawamura et al. ..... 123/399

FOREIGN PATENT DOCUMENTS

| | | |
|---|---|---|
| JP | 03-000945 | 1/1991 |
| JP | 8-270487 A | 10/1996 |
| JP | 11-229943 A | 8/1999 |
| JP | 11-257139 A | 9/1999 |

* cited by examiner

*Primary Examiner*—Bibhu Mohanty
(74) *Attorney, Agent, or Firm*—Sughrue Mion, PLLC

(57) ABSTRACT

An ECU 2 performs ON/OFF judgments on an ignition switch. When the ignition switch is OFF, a judgment is made whether or not voltage learning for a fully opened position of a throttle valve 34 is complete. If complete, an electric power for a DC motor 31 is cutoff. A TPS output voltage value is read in, and a judgment is made whether or not a given period of time has elapsed. If the given period of time has elapsed, and if a throttle position sensor output voltage value VTPS is equal to or greater than a given value, then a judgment is made that there is a return spring 35 breakage failure. Breakage to the return spring 35 can thus be reliably detected.

7 Claims, 6 Drawing Sheets

THROTTLE VALVE CONTROL DEVICE

BACKGROUND OF THE INVENTION

1. Field of the Invention

The present invention relates to a throttle valve control device. In particular, the present invention relates to a throttle valve control device that detects an amount of opening degree of a throttle valve, which is provided within an intake pipe of an engine used in an automobile, to perform feedback control of the throttle valve to a position having a desired opening degree by using a throttle actuator.

2. Description of the Related Art

In a conventional throttle abnormality detection device in an internal combustion engine, for detecting return spring abnormalities of a throttle actuator, a throttle controlling means controls an opening degree of the throttle valve using a DC motor based on an amount that an accelerator pedal is pressed. Actual torque that the motor generates is detected by a torque detecting means, and an amount of fluctuation in the torque is detected for every given period of time by a fluctuation amount detecting means. If the amount of fluctuation in the torque is equal to or less than a given value, it is judged that there is breakage to the return spring of the throttle valve (refer to JP 08-270487, for example).

In general, in an electronic throttle system having a return spring and a DC motor as sources for return energy, if a frictional torque of a throttle valve drive system changes greatly (increase) due to breakage of the return spring of the throttle valve, throttle valve tracking characteristics (responsiveness) for throttle valve operations in response to accelerator pedal operations by a driver will deteriorate. An engine driving force may develop against the intention of the driver, which is extremely undesirable.

Further, if the frictional torque of the throttle valve driver system does not change greatly due to the breakage of the return spring of the throttle valve, the tracking characteristics for the throttle valve operations in response to the accelerator pedal operations by the driver are secured. Conversely, if there is an abnormality in an electric system of the DC motor, such as a breaking of wires of the DC motor terminals, while the driver presses the accelerator into a fully opened state, there is no energy sources for returning the throttle valve even if the accelerator pedal is returned to a fully closed position. As a result, the throttle valve stays in the fully opened position, and an engine driving force may develop against the intention of the driver, which is extremely undesirable.

In the conventional throttle abnormality detection device described above, the torque generated by the DC motor is detected, and compares the amount of fluctuation in the torque detected for every given period of time with a given value, thus performing abnormality judgment on the throttle valve. However, there are large fluctuations in the torque of a throttle valve shaft itself during engine operation, such as: changes in torque constant of the DC motor due to individual differences in the torque characteristics of the throttle shaft of the throttle actuator and temperature changes (reduction in magnet force of permanent magnetism); changes in viscous resistance of a lubricant in a speed reduction gear portion; transient contaminants that engage in between a valve and a bore; and changes over time in an amount of adhered sludge. As a result, misjudgments tend to occur for the above-mentioned cases. In addition, there occurred such problems that the detection precision became worse, etc. when the given value used in the judgments is made larger in order to avoid the misjudgments.

SUMMARY OF THE INVENTION

The present invention has been made in order to solve the above-mentioned problems. An object of the present invention is to provide a throttle valve control device capable of preventing misjudgments of breakage failures to a return spring of a throttle valve, thereby being capable of detecting the breakage of the return spring with good precision.

The present invention provides a throttle valve control device includes: a throttle valve for adjusting an air intake amount supplied to an engine; a throttle position sensor for detecting an opening degree of the throttle valve; a motor for driving the throttle valve; a throttle actuator having a return spring for biasing the throttle valve in a fully closed direction; and a throttle valve controlling means for driving the motor so as to control an opening degree position of the throttle valve based on the opening degree of the throttle valve detected by the throttle position sensor. In the throttle valve control device, the throttle valve controlling means drives the motor so that the throttle opening degree position of the throttle valve is come equal to or greater than a predetermined opening degree position, cuts off an electric power supplied to the motor. After that, the throttle valve controlling means judges that there is a breakage failure of the return spring in a case that an output value of the throttle position sensor after elapsing a given period of time after the cutoff of the electric power is equal to or larger than a predetermined value. Therefore, the throttle valve control device prevents misjudgments of breakage failures to a return spring of a throttle valve and is capable of detecting breakage to the return spring with good precision.

DETAILED DESCRIPTION OF THE PREFERRED EMBODIMENT

Figure 1:
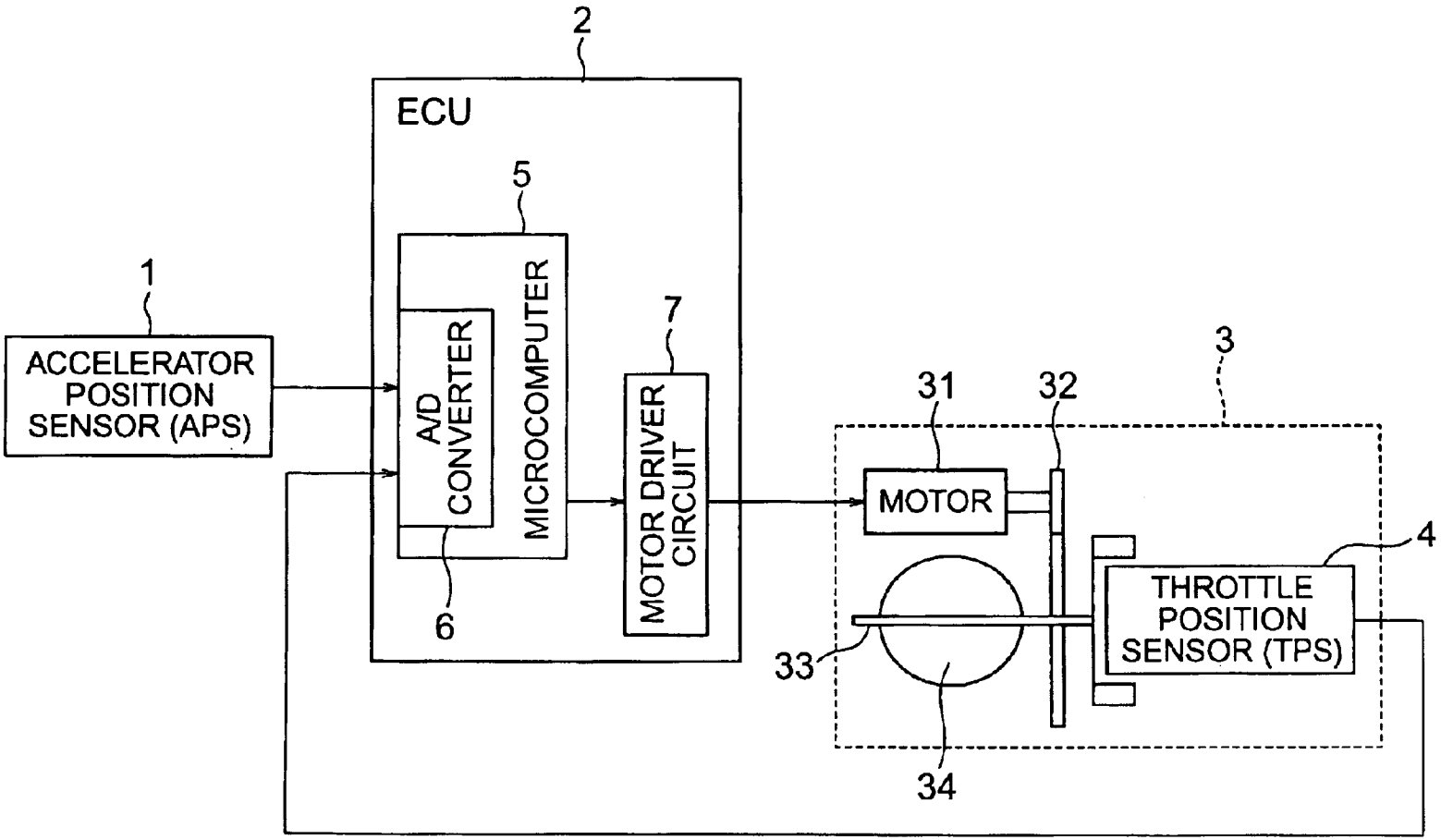
FIG. 1 is a schematic structural view for showing a configuration of a throttle valve control device according to an embodiment of the present invention.

An embodiment of the present invention is explained below. FIG. 1 is a schematic structural view for showing a configuration of a throttle valve control device according to an embodiment of the present invention, the control device controlling an amount of air intake of an engine. As shown in FIG. 1, an ECU 2 is connected to an accelerator position sensor (APS) 1, and a throttle actuator 3 is connected to the ECU 2. The accelerator position sensor 1 is a sensor that detects the position of an accelerator pedal as an accelerator opening degree. Further, the ECU 2 is an electronic control unit that performs various types of engine control, and includes a throttle control means (not shown) that performs control of the amount of air intake of the engine. As shown in FIG. 1, the ECU 2 has a microcomputer 5, a DC motor driver circuit 7, and the like. An A/D converter 6 is provided in the microcomputer 5 in order to perform A/D conversion of an accelerator opening degree signal from the accelerator position sensor 1. The A/D converted accelerator opening degree signal is read in as an accelerator opening degree voltage value, and at minimum, an engine rotation speed signal (not shown) is input. Based on those values, a target throttle valve opening degree position is computed for a throttle valve 34 that is discussed later. In addition, a control signal (DUTY signal at a time of PWM drive, for example) that is computed by feedback (F/B) control (PID control, for example) of the throttle opening degree position is output to the DC motor driver circuit 7 in order to make a throttle opening degree position signal input from a throttle position sensor (TPS) 4, discussed later, coincide with the target throttle opening degree position. A desired current thus flows in the DC motor 31, driving the DC motor 31, and the opening degree position of the throttle valve 34 is controlled.

As shown in FIG. 1, the throttle valve 34 that regulates the amount of air intake to the engine, the throttle position sensor 4 that detects the opening degree of the throttle valve 34, and the DC motor 31 that drives the throttle valve 34 through a speed reduction gear 32 and a throttle shaft 33, are provided within the throttle actuator 3. A driving force of the DC motor 31 is transmitted to the throttle shaft 33, through the speed reduction gear 32, in the throttle actuator 3 having this type of structure. The throttle valve 34 is thus driven. The position of the throttle valve is detected as the throttle opening degree by the throttle position sensor 4. As discussed above, A/D conversion is performed on the throttle opening degree signal in the A/D converter 6 within the microcomputer 5, and the converted signal is read in by the microcomputer 5 as a throttle opening degree voltage value.

Figure 2:
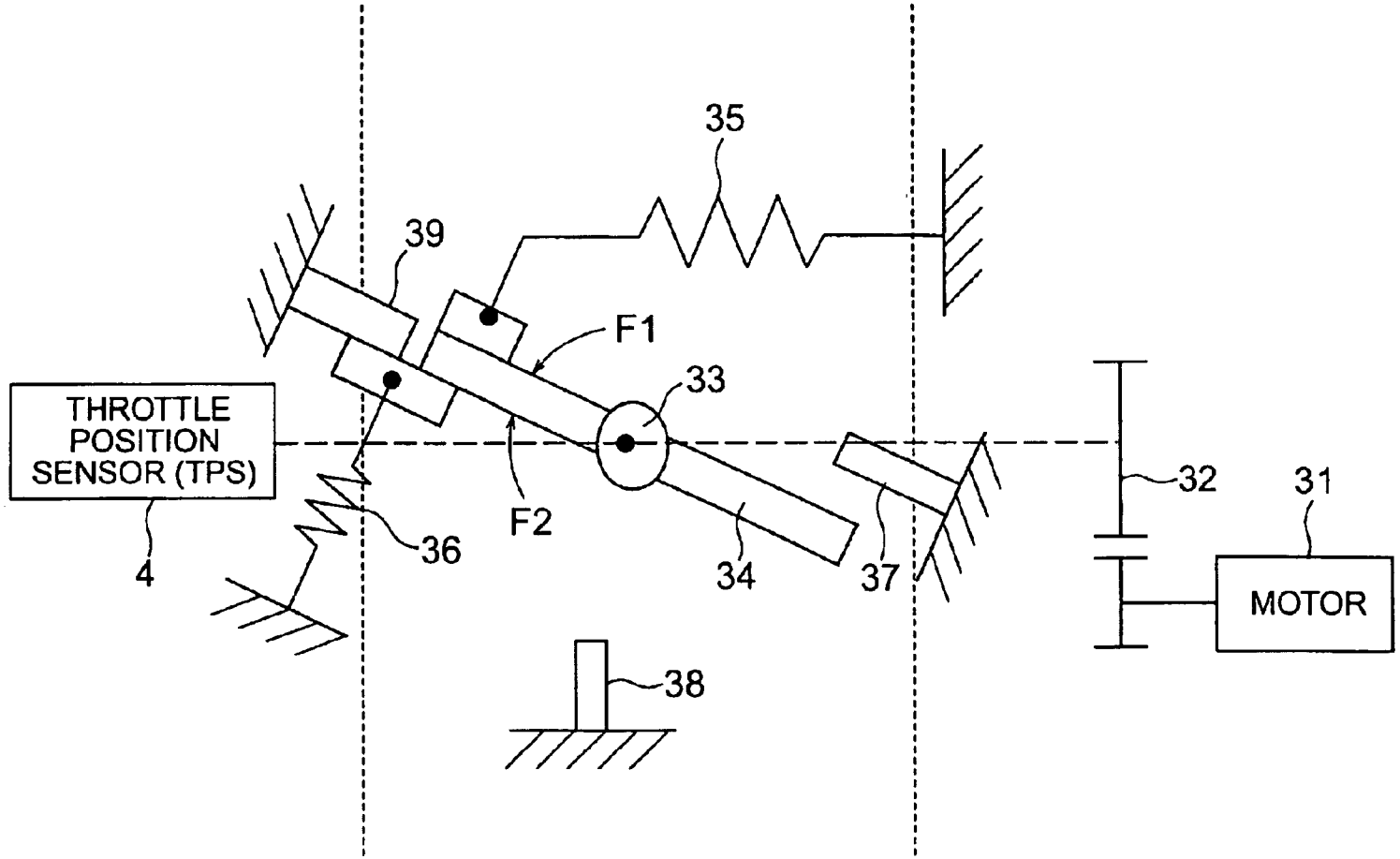
FIG. 2 is an explanatory diagram for showing a throttle valve stop position when power supply to a DC motor is cutoff for a case where a return spring is normal in a throttle valve control device according to the embodiment of the present invention.
Figure 3:
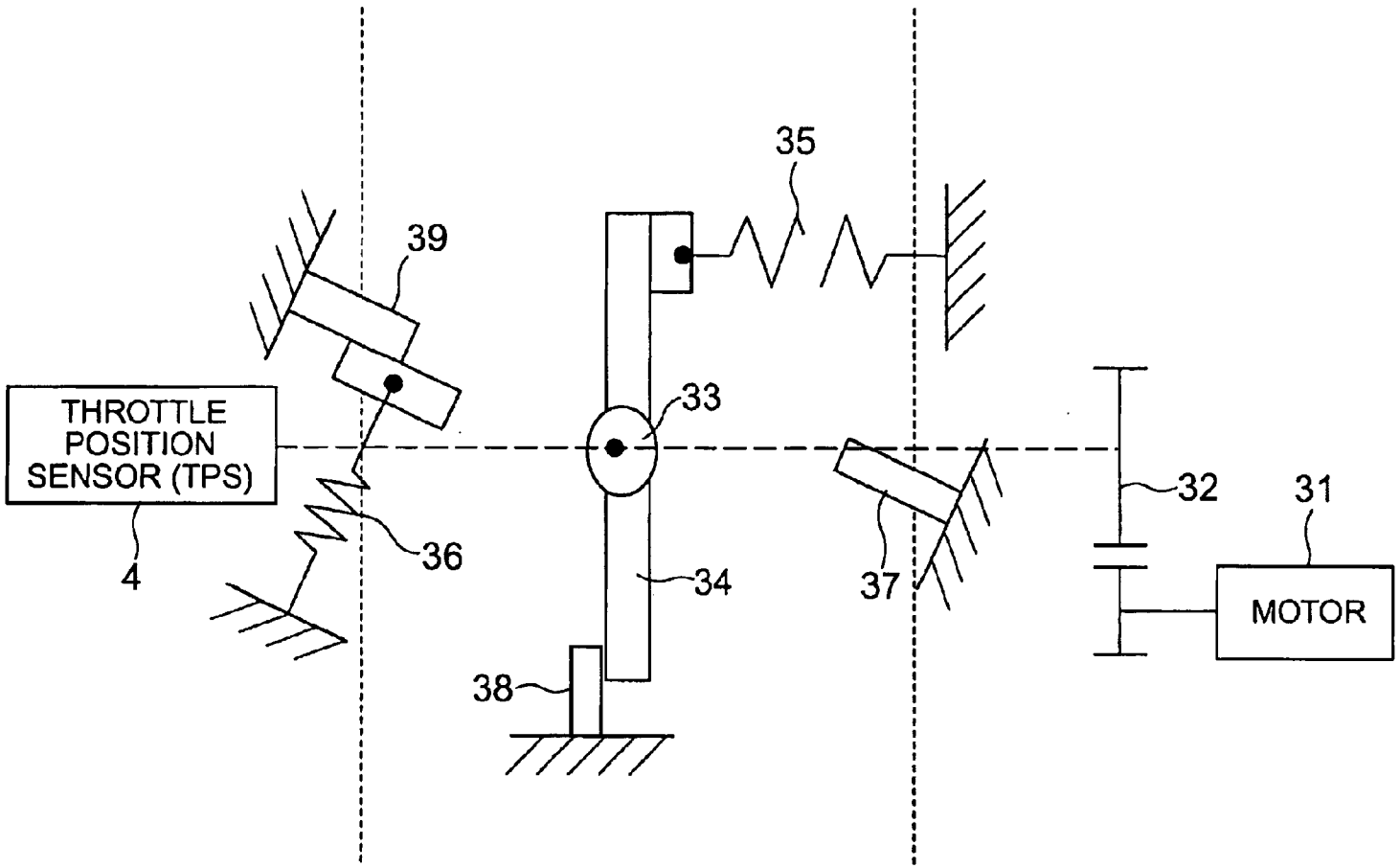
FIG. 3 is an explanatory diagram for showing a throttle valve stop position when the power supply to the DC motor is cutoff at a fully opened position of the throttle valve for a case where the return spring is broken in the throttle valve control device according to the embodiment of the present invention.

FIG. 2 and FIG. 3 are diagrams that schematically show relationships for forces acting on the throttle shaft 33 of the throttle actuator 3. Identical reference symbols are used in those figures for elements that are the same as in the configuration shown in FIG. 1, and their explanation is omitted here. It should be noted that reference numeral 35 in those figures denotes a return spring, reference numeral 36 denotes an opener spring, reference numeral 37 denotes a fully closed stopper position of the throttle valve 34, reference numeral 38 denotes a fully opened stopper position of the throttle valve 34, and reference numeral 39 denotes a default opening degree stopper position.

FIG. 2 is a diagram for showing a stop position of the throttle valve 34 for cases where the return spring 35 is in a normal state and the DC motor 31 is a non-energized state. When the DC motor 31 is non-energized, a torque generated by the DC motor 31 becomes zero, and therefore the DC motor driving force does not act on the throttle shaft 33 through the speed reduction gear 32. A biasing force F1 of the return spring 35 and a biasing force F2 of the opener spring 36 act on the throttle shaft 33. However, a relationship is set so that the opener spring biasing force F2 is greater than the biasing force F1 of the return spring, and therefore the throttle valve 33 is stopped at the default opening degree stopper position 39. When the DC motor 31 is driven in the same direction as that of the return spring biasing force F1, the throttle valve 34 rotates to the fully closed stopper position 37, resisting the opener spring biasing force F2, and stops. On the other hand, when the DC motor 31 is driven in a direction that resists the return spring biasing force F1, the throttle valve 34 swings to the fully opened stopper position 38, and stops.

FIG. 3 is a diagram for showing a stopping position for the throttle valve 34 for cases where the return spring 35 is in a broken state, the throttle valve 34 is driven to the fully opened stopper position 38 by the DC motor 31, and an electric power supplied to the DC motor 31 is cutoff. The return spring biasing force F1 becomes zero when the DC motor driving force is zero and the return spring is broken. The throttle shaft 33 is placed in a free state, and therefore the throttle valve 34 stops in the fully opened stopper position 38. The position of the throttle valve 34 can be monitored by means of an output valve of the throttle position sensor 4 that is coupled to the throttle shaft 33.

Figure 4:
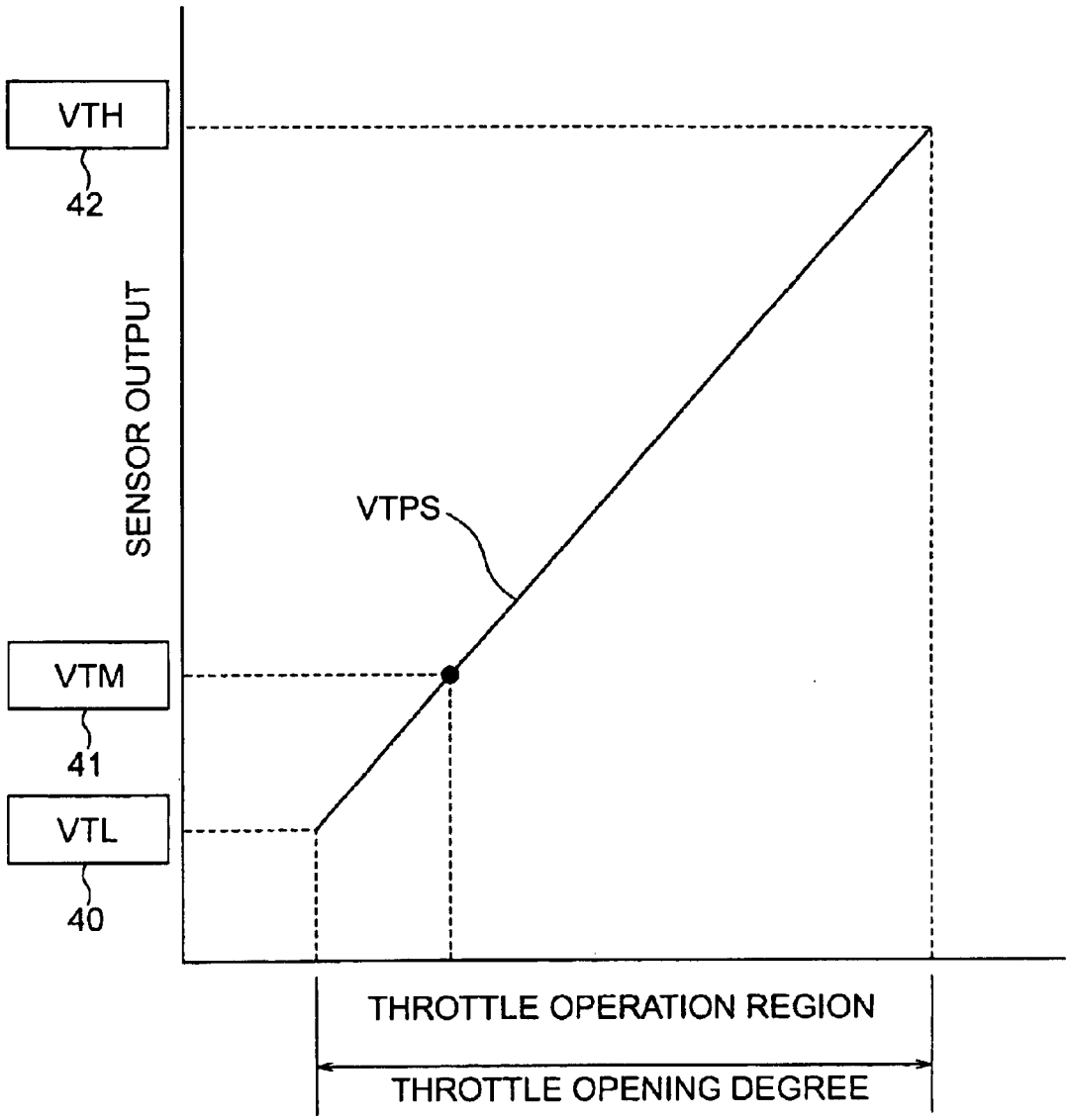
FIG. 4 is an explanatory diagram for showing output characteristics for a throttle position sensor in the throttle valve control device according to the embodiment of the present invention.

FIG. 4 is a diagram for showing output characteristics of the throttle position sensor 4. An output voltage VTL 40 of the throttle position sensor 4 is a sensor output voltage value (0.5V, for example) for cases where the throttle valve 34 is stopped at the fully closed stopper position 37. An output voltage VTH 42 is a sensor output voltage value (4.5 V, for example) for cases where the throttle valve 34 is stopped at the fully opened stopper position 38. An output voltage VTM 41 is a sensor output voltage value (0.8 V, for example) for cases where the throttle valve 34 is stopped at the default opening degree stopper position 39 when the DC motor 31 is not energized.

Figure 5:
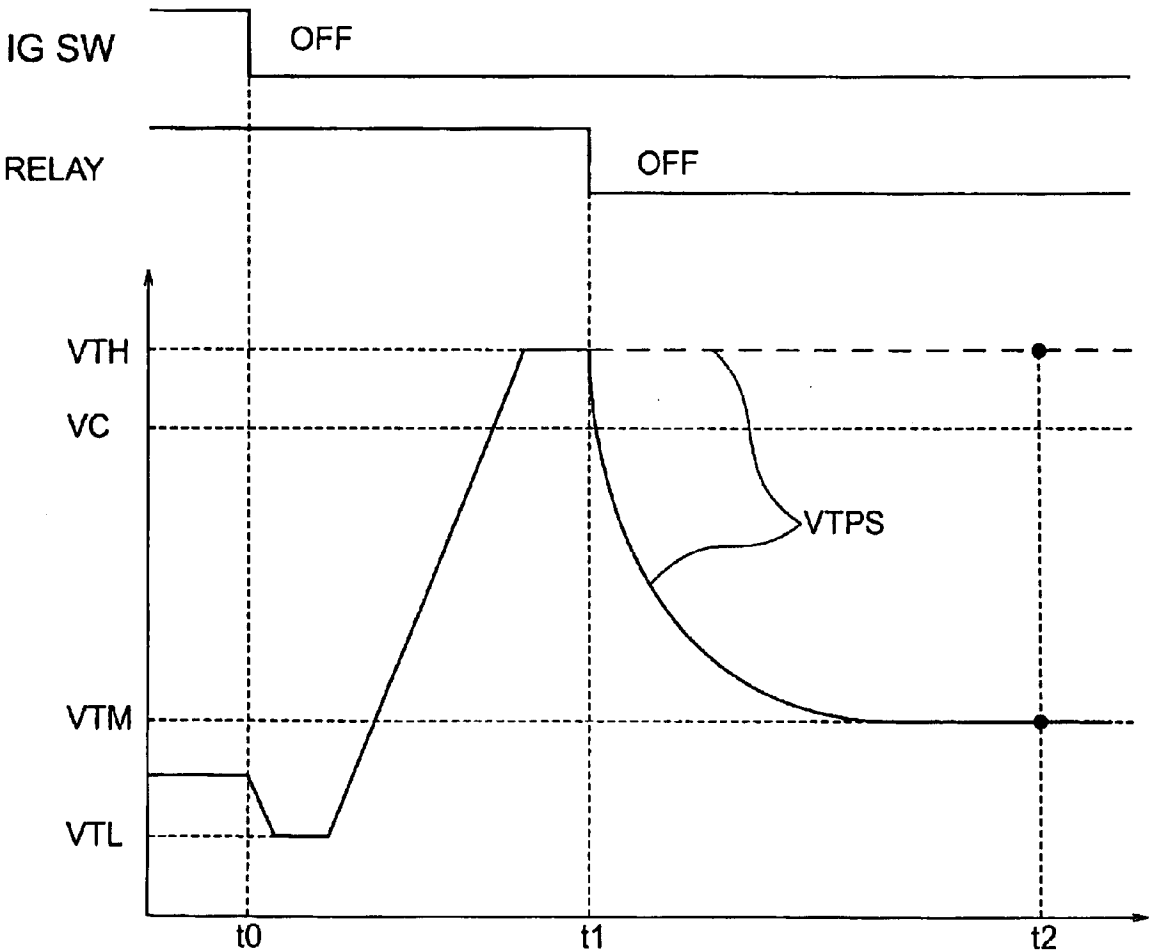
FIG. 5 is a timing diagram for showing output voltage changes of the throttle position sensor for cases where there is, and is not, breakage to a return spring during cutoff of the power supply to the DC motor at the fully opened position of the throttle valve in the throttle valve control device according to the embodiment of the present invention.

FIG. 5 is a timing chart for showing changes in an output voltage (VTPS) of the throttle position sensor 4 for cases where the electric power supplied to the DC motor 31 is cutoff (by turning a relay, not shown, used for supplying the electric power to the motor in this embodiment) after learning the fully opened position of the throttle valve 34 when an engine ignition switch (IG SW), not shown, is OFF. When the engine ignition switch is OFF, the microcomputer 5 starts a timer (t=t0), and drives the DC motor 31, pushing the throttle valve 34 against the fully closed stopper position 37 and the fully opened stopper position 38. The throttle position sensor output voltage value (VTPS) for each of the stopper positions is read in, thus performing learning of the fully closed position electric voltage VTL and the fully opened position voltage VTH. Changes in the throttle position sensor output voltage (VTPS) for cases where the electric power supplied to the DC motor 31 is cutoff by the relay, not shown, after learning of the fully opened position voltage VTH is complete (point where t=t1) are within a given period of time (1.0 sec, for example) when the return spring 35 is normal. The throttle valve 34 returns to the default opening degree stopper position 39, coinciding with the default opening degree position voltage VTM. For cases where there is breakage to the return spring 35, the return spring biasing force F1 equals zero, and the DC motor torque equals zero. The throttle valve 34 therefore stays as is at the fully opened stopper position 38, and the throttle position sensor output voltage (VTPS) maintains a substantially constant value at the fully opened position voltage VTH. The throttle position sensor output voltage value (VTPS) is read in after a given amount of time (3.0 sec, for example), (at point t=t2), that provides sufficient time allowance for the throttle valve 34 to return to the default opening degree position from the point (at point t=t1) where the electric power supplied to the DC motor 31 is cutoff. For cases where the throttle position sensor output voltage value (VTPS) is equal to or greater than a given voltage value VC (4.0 V, for example), the return spring 35 is judged to be broken, and a return spring breakage flag is set to ON state and stored.

Figure 6:
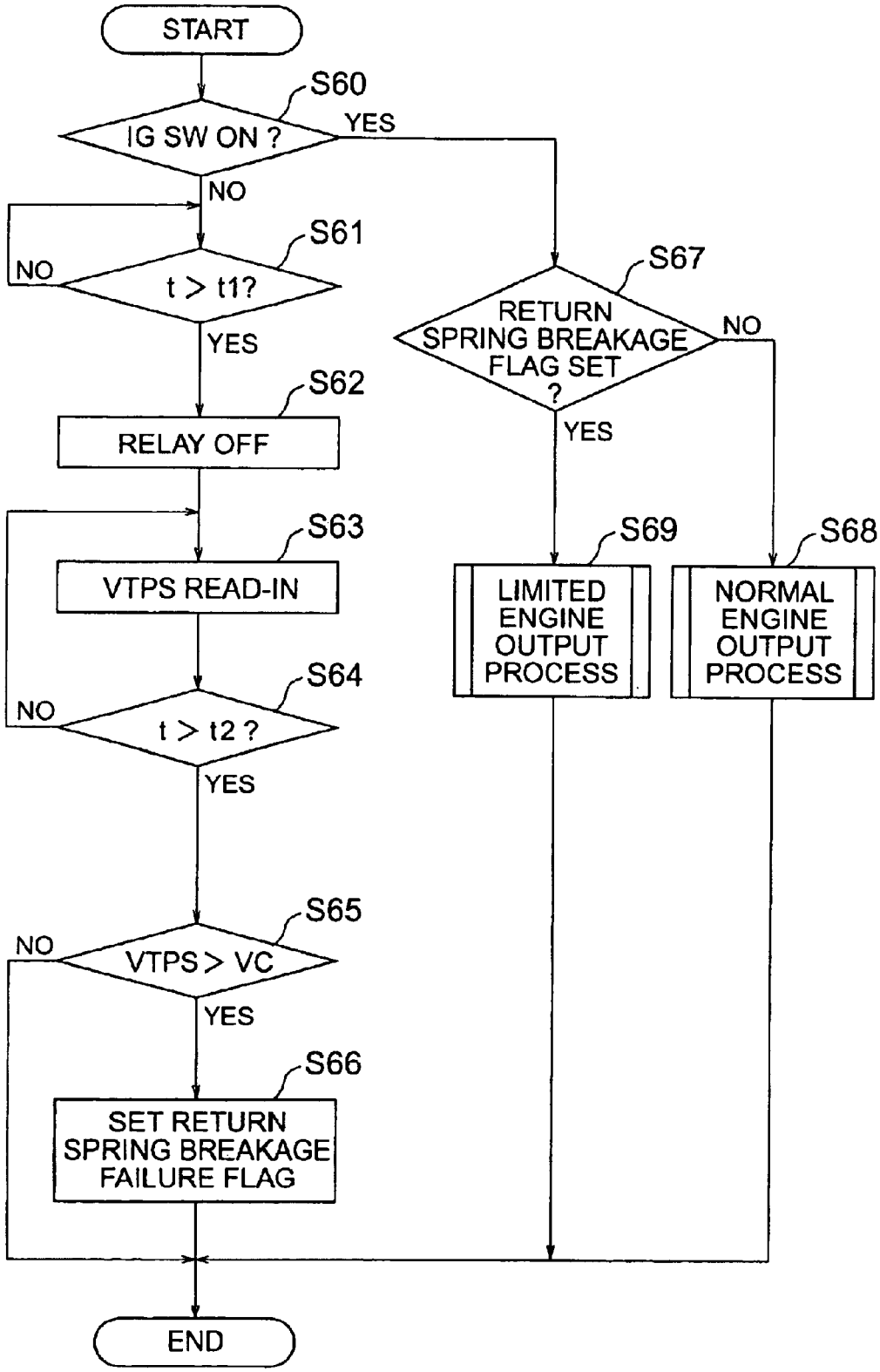
FIG. 6 is a flow diagram for showing the flow of a return spring breakage failure judgment process in the throttle valve control device according to the embodiment of the present invention.

FIG. 6 is a diagram for showing a flow for a process of judging a breakage failure of the return spring 35. In a step S60, judgment of whether the engine ignition switch (IGSW) is ON or OFF is performed. For cases where the engine ignition switch is OFF, a judgment is made in a step S61 as to whether or not learning of the fully opened position voltage of the throttle valve 34 is complete (timer value t>t1, where t1 is a given value set in advance). If learning is complete (the timer value t>t1), then the electric power supplied to the DC motor 31 is cutoff in a step S62 (the relay is set to OFF), the throttle position sensor output voltage value (VTPS) is read in during a step S63, and processing proceeds to a step S64. In the step S64, a judgment is made as to whether or not a given period of time, set in advance (3.0 sec, for example), that provides sufficient time allowance for the throttle valve 34 to return to the default opening stopper position 39 (corresponding to the default opening degree position voltage VTM) by the return spring biasing force F1 from the point at which the electric power supplied to the DC motor is cutoff (timer value t=t1), has elapsed (the timer value t>t2). Processing proceeds to a step S65 when the given period of time has elapsed (timer value t>t2). Processing returns to the step S63 for cases where the given period of time has not elapsed (timer value t ≦t2), and the throttle position sensor output voltage value (VTPS) is read in. In the step S65, a judgment is made as to whether or not the throttle position sensor output voltage value (VTPS) is greater than the given voltage value VC that is set in advance (4.0 V, for example). Processing stops for cases where VTPS≦VC. For cases where VTPS >VC, processing proceeds to a step S66, and a breakage failure to the return spring is judged. The return spring breakage failure flag is set to ON state, and stored.

For cases where the engine ignition switch is ON in the step S60, the return spring breakage failure flag previously stored is read in during a step S67, and a judgment is made as to whether or not the flag is set to ON state. The return spring is normal if the flag is not set to ON state, and therefore normal engine output processing is performed in a step S68. For cases where the flag has been set to ON state, the return spring 35 is judged to have a breakage failure, and engine output limiting is performed in a step S69. (For example, for cases where a failure mode develops where the DC motor drive becomes impossible after obtaining the return spring breakage failure judgment, engine output limiting is variably set by sufficiently, controlling the engine output by cutting fuel to one half of the number of cylinders used normally, or the like, thus assuring safety. In addition, when the DC motor drive is possible, the APS output voltage is set to a given multiple factor (0.5, for example), the target opening value of the throttle valve is computed, and opening limitation of the throttle valve 34 is performed.) An driver is warned of the abnormality of the throttle actuator 3 by worsening drivability, and this promotes early part replacement of the throttle actuator 3.

As described above, according to the throttle valve control device of the present invention, the ECU 2 drives the DC motor 31 so that the throttle valve opening degree position of the throttle actuator 3 is in the fully closed stopper position 37 and the fully opened stopper position 38 that exceed given opening degree positions. Thereafter, the throttle position sensor output voltage value VTPS is read in at each of the positions, and the values are learned. After learning is complete, the electric power supplied to the DC motor 31 is cutoff. For cases where the throttle position sensor output voltage value VTPS is equal to or greater than a given value after elapsing a given period of time that provides sufficient time allowance for the throttle valve 34 to return to the default opening degree throttle position 39 by the return spring biasing force F1, the return spring 35 is judged to have a breakage failure. An effect is thus obtained where breakage to the return spring can be reliably detected.

Further, according to the throttle valve control device of the present invention, the ECU 2 performs learning of the throttle position sensor output voltage value VTPS in the fully closed stopper position 37 and the fully opened stopper position 38 when the engine ignition switch is OFF, and judges whether or not the return spring has a breakage failure. Breakage to the return spring can therefore be reliably detected when the engine is stopped, and an engine output that is contrary to the intention of the driver can be prevented from generating during engine operation. An effect is thus obtained in which safe operation can be performed.

Further, according to the throttle valve control device of the present invention, the ECU 2 cuts of the electric power supplied to the DC motor 31 during learning of the throttle valve fully opening degree position after the engine ignition switch is OFF, and performs breakage failure detection on the return spring 35. The return spring breakage failure flag is set to ON state and stored for cases where breakage is detected. An effect is thus obtained in which breakage failures of the return spring 35 can be judged when the engine ignition switch is next turned ON.

Further, according to the throttle valve control device of the present invention, the ECU 2 performs engine output limiting for cases where the return spring breakage failure flag is set to ON state when the engine ignition switch is turned ON. An effect is thus obtained where the driver is made to recognize the abnormality in an electronic throttle system by worsening drivability, and early part replacement can thus be promoted.

Further, according to the throttle valve control device of the present invention, the ECU 2 variably sets engine output limiting according to the throttle position sensor output voltage value for cases where the return spring breakage failure flag is set to ON state when the engine ignition switch is ON and a failure mode develops where the DC motor 31 drive becomes impossible. An effect is thus obtained where the engine output can be sufficiently controlled, and safety can be ensured, for cases where the throttle valve stays in a high opening degree position due to air currents or the like.

What is claimed is:

1. A throttle valve control device comprising:

a throttle valve for adjusting an air intake amount supplied to an engine;

a throttle position sensor for detecting an opening degree of said throttle valve;

a motor for driving said throttle valve;

a throttle actuator having a return spring for biasing said throttle valve in a fully closed direction; and a throttle valve controlling means for driving said motor so as to control an opening degree position of said throttle valve based on the opening degree of the throttle valve detected by said throttle position sensor, wherein said throttle valve controlling means drives said motor so that the throttle opening degree position of said throttle valve is come equal to or greater than a predetermined opening degree position, cuts off an electric power supplied to said motor, judges that there is a breakage failure of said return spring in a case that an output value of said throttle position sensor after elapsing a given period of time after the cutoff of the electric power is equal to or larger than a predetermined value, stores said breakage failure, and variably sets an output limit for said engine in a case that said breakage failure is stored.

2. A throttle valve control device according to claim 1, wherein said throttle valve controlling means performs breakage failure judgment on said return spring when said engine ignition switch is set to off.

3. A throttle valve control device according to claim 1, wherein said throttle valve controlling means stores a return spring breakage failure flag set to ON state in a case that a result of the breakage failure judgment is failure.

4. A throttle valve control device according to claim 3, wherein said throttle valve controlling means performs an output limit for said engine in a case that said return spring breakage failure flag is set to ON state when said engine ignition switch is set to on.

5. A throttle valve control device according to claim 3, wherein said throttle valve controlling means variably sets an output limit for said engine according to a value output by said throttle position sensor in a case that said return spring breakage failure flag is set to ON state and drive of said motor is impossible when the engine ignition switch is set to on.

6. A throttle valve control device according to claim 2, wherein said throttle valve controlling means stores a return spring breakage failure flag set to ON state in a case that a result of the breakage failure judgment is failure.

7. A throttle valve control device according to claim 2, wherein said throttle valve controlling means variably sets an output limit for said engine according to a value output by said throttle position sensor in a case that said return spring breakage failure flag is set to ON state and drive of said motor is impossible when the engine ignition switch is set to on.

* * * * *